US006514401B2

(12) United States Patent
Chyou et al.

(10) Patent No.: US 6,514,401 B2
(45) Date of Patent: Feb. 4, 2003

(54) ANTI-BIOFOULING SYSTEM

(75) Inventors: San-Der Chyou, Shu-Lin (TW); Wen-Chi Chiang, Keelung (TW); Ran Huang, Keelung (TW); Jiann-Kuo Wu, Keelung (TW)

(73) Assignee: Taiwan Power Company, Taipei (TW)

( * ) Notice: Subject to any disclaimer, the term of this patent is extended or adjusted under 35 U.S.C. 154(b) by 69 days.

(21) Appl. No.: 09/847,152

(22) Filed: May 2, 2001

(65) Prior Publication Data

US 2002/0162753 A1 Nov. 7, 2002

(51) Int. Cl.[7] ..... C23F 13/00

(52) U.S. Cl. ..... 205/739; 205/740; 205/730; 204/196.37; 204/196.38; 204/196.16; 204/196.18; 204/196.19; 204/196.1

(58) Field of Search ..... 204/196.01, 196.16, 204/196.18, 196.19, 196.37, 196.38, 196.1, 737; 205/724, 739, 740, 730

(56) References Cited

U.S. PATENT DOCUMENTS 3,868,313 A * 2/1975 Gay ..... 204/196.37
4,880,517 A * 11/1989 Bennett et al. ..... 204/196.37
5,088,432 A * 2/1992 Usami et al. ..... 204/196.37

* cited by examiner

*Primary Examiner*—Bruce F. Bell
(74) *Attorney, Agent, or Firm*—Volpe and Koenig, PC

(57) ABSTRACT

An anti-biofouling system adapted to be used for an underwater structure immersed in seawater is disclosed. The anti-biofouling system includes a conductive layer, comprising carbon fiber, graphite powder and binder, formed on a surface of the underwater structure for serving as an anode, a cathode, and a power supply for providing a current, thereby performing an electrolytic reaction for the anti-biofouling system such that a fouling organism is prohibited from attaching on the surface of the underwater structure.

20 Claims, 9 Drawing Sheets

ANTI-BIOFOULING SYSTEM

FIELD OF THE INVENTION

The present invention is related to an anti-biofouling system adapted to be used for an underwater structure, and more particularly to an anti-biofouling system adapted to be used for an underwater structure by serving a conductive layer formed on a surface of the underwater structure as an anode.

BACKGROUND OF THE INVENTION

Generally, for cooling the equipments, the nuclear power plants or other plants are located by the sea. However, the fouling organisms, including the microfouling organisms and the macrofouling organisms, easily attach themselves to a surface of a seawater inlet of the plants and thus resulting in a serious problem of biofouling. Not only the underwater structures immersed in the seawater are much more easily corroded, but also the flux of the seawater flowing into the seawater inlet are inevitably lowered. What we may anticipate is that the cooling efficiency would be lowered in the end. Certainly, there is such a problem for the ships sailing in the sea as well.

Conventionally, the anti-biofouling coating materials containing a heavy metal, e.g. copper, arsenic, lead or mercury, or a organic compound, e.g. tributyl tin (TBT), are formed on the surface of the underwater structure for preventing the problem of biofouling. In spite of the problem of biofouling is solved by forming such a toxic coating layer on the surface of the underwater structure, a problem of environmental pollution arises concurrently.

Accordingly, it is attempted by the present applicant to overcome the above-described problems encountered in the prior arts.

SUMMARY OF THE INVENTION

An object of the present invention is to provide an anti-biofouling system for prohibiting the fouling organisms from attaching on a surface of an underwater structure immersed in seawater.

Another object of the present invention is to provide a method for prohibiting the fouling organisms from attaching on a surface of an underwater structure immersed in seawater.

In a first aspect, the present invention is related to an anti-biofouling system adapted to be used for an underwater structure immersed in seawater. The anti-biofouling system includes a conductive layer, comprising carbon fiber, graphite powder and binder, formed on a surface of the underwater structure for serving as an anode, a cathode, and a power supply for providing a current, thereby performing an electrolytic reaction for the anti-biofouling system such that a fouling organism is prohibited from attaching on the surface of the underwater structure.

Preferably, the underwater structure is a metal structure.

Preferably, an insulating layer is further formed between the surface of the underwater structure and the conductive layer.

Preferably, the insulating layer is an epoxy layer.

Preferably, the cathode is a plurality of areas uncovered by the insulating layer and the conductive layer on the surface of the underwater structure.

Preferably, the underwater structure is a non-metal structure.

Preferably, the cathode is a remote underwater metal structure.

Preferably, a particle size of the graphite powder is ranged from 3 to 5 microns in diameter.

Preferably, a content of the graphite powder contained in the conductive layer is ranged from 15 to 25%.

Preferably, the binder is selected from a group consisting of ethyl-silicate resin, silicate resin, acrylic resin and polyurethane resin.

In another aspect, the present invention is related to a method for prohibiting a fouling organism from attaching on a surface of an underwater structure immersed in seawater. The method includes steps of (a) providing an anti-biofouling system, and (b) performing an electrolytic reaction by the anti-biofouling system, wherein the anti-biofouling system includes a conductive layer, comprising carbon fiber, graphite powder and binder, formed on the surface of the underwater structure for serving as an anode, a cathode, and a power supply for providing a current.

Preferably, the current is provided by the power supply for one hour everyday.

Preferably, a current density of the anode is ranged from $3\times10^{-4}$ to $5\times10^{-4}$ A/cm$^2$.

Preferably, the underwater structure is a metal structure.

Preferably, an insulating layer is further formed between the surface of the underwater structure and the conductive layer.

Preferably, the insulating layer is an epoxy layer.

Preferably, the cathode is composed of a plurality of areas on the surface of the underwater structure where the insulating layer and the conductive layer are not formed thereon.

Preferably, the underwater structure is a non-metal structure.

Preferably, the cathode is a remote underwater metal structure.

Preferably, the binder is selected from a group consisting of ethyl-silicate resin, silicate resin, acrylic resin and polyurethane resin.

The present invention may best be understood through the following description with reference to the accompanying drawings, in which:

DETAILED DESCRIPTION OF THE PREFERRED EMBODIMENTS

Figure 1:
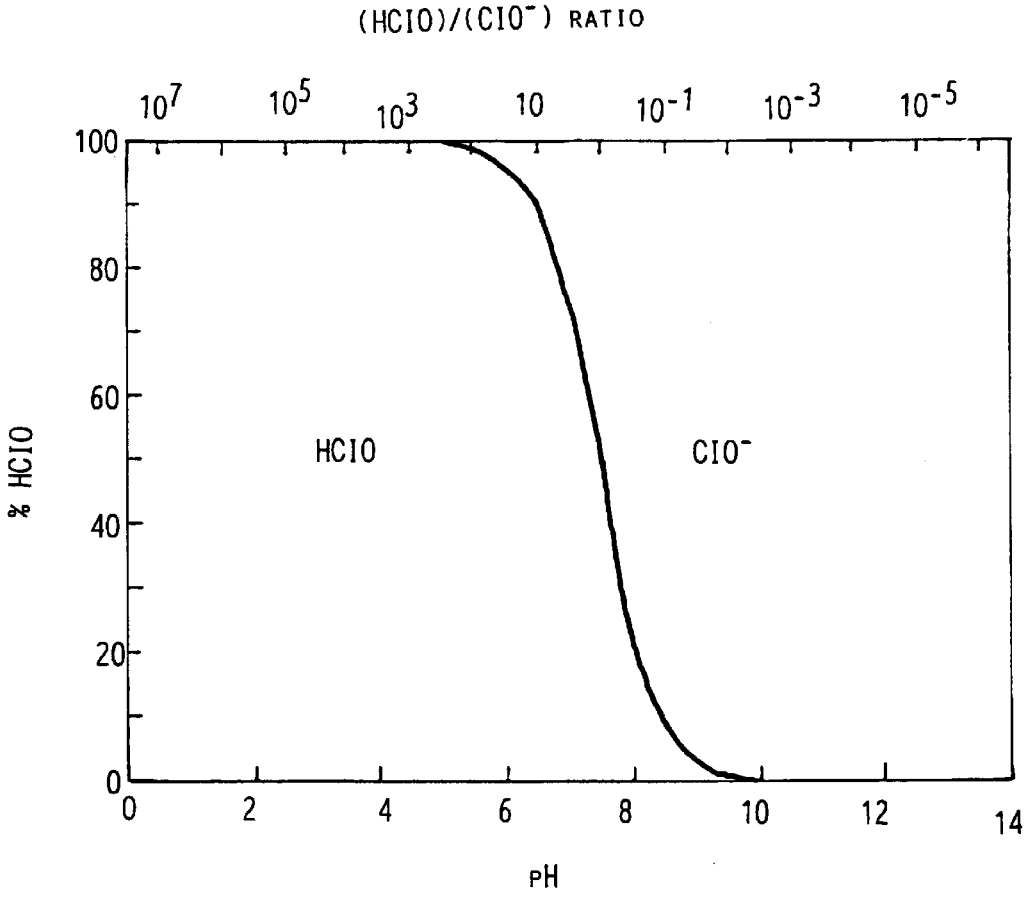
FIG. 1 is a schematic diagram showing the relation of the pH value and the relative proportion of the hypochlorite ion ($ClO^-$) and the hypochlorius acid (HClO)

The present invention employs an electrolytic reaction to prohibit the fouling organisms from attaching on a surface of an underwater structure immersed in seawater. A conductive layer, comprising carbon fiber, graphite powder and binder, formed on the surface of the underwater structure serves as an anode. The seawater serves as the electrolytic solution. When the electrolytic reaction is performed, the free chlorine, that is hypochlorite ion ($ClO^-$), would be produced from the conductive layer. The experimental data shows that the fouling organisms can be effectively prohibited from attaching on the surface of the underwater structure when the concentration of the free chorine away from the surface for 50~100 microns is higher than 0.05 ppm.

Principle of Electrolytic Reaction

The pH value of seawater is around eight, and the primary ingredient of which is sodium chloride. When an electrolytic reaction is performed, a series of reactions as follows would occur.

Anode:

$$2\ Cl^- \rightarrow Cl_2 + 2\ e^- \quad (1)$$

$$4\ OH^- \rightarrow O_2 + 2H_2O + 4\ e^- \quad (2)$$

$$Cl^- + 2\ OH^- \rightarrow ClO^- + H_2O + 2\ e^- \quad (3)$$

Cathode:

$$2\ H^+ + 2e^- \rightarrow H_2 \quad (4)$$

$$O_2 + 2\ H_2O + 4\ e^- \rightarrow 4\ OH^- \quad (5)$$

Once the $Cl_2$ produced in equation (1) is dissolved in seawater, a reaction as shown in the equation (6) would occur immediately.

$$Cl_2 + 2\ OH^- \rightarrow ClO^- + Cl^- + H_2O \quad (6)$$

Because both of the equations (3) and (6) produce $ClO^-$, an equilibrium as shown in the equation (7) will occur and be maintained.

$$H^+ + ClO^- = HClO \quad (7)$$

The equilibrium of the equation (7) is maintained on the basis of the pH value of seawater. In other words, referring to FIG. 1, the concentrations of the hypochlorite ion ($ClO^-$) and the hypochlorous acid (HClO) are related to the pH value of seawater. As long as the concentration of the free chlorine, including the hypochlorite ion ($ClO^-$) and the hypochlorous acid (HClO), is higher than a specific value, the fouling organisms would be prohibited from attaching on the surface of the underwater structure.

In addition, the ammonia or other ammonium-deriving compounds contained in seawater would react with the hypochlorous acid (HClO) and produce different types of products as shown below. These types of products are all named as combined chlorine.

$$NH_3 + HClO \rightarrow H_2O + NH_2Cl \quad (8)$$

$$NH_2Cl + HClO \rightarrow H_2O + NHCl_2 \quad (9)$$

$$NHCl_2 + HClO \rightarrow H_2O + NCl_3 \quad (10)$$

Conventionally, the total chlorine or the total residual chlorine includes the free chlorine and the combined chlorine.

According to the present invention, the amount of the free chlorine produced from the conductive layer is so few that the produced free chlorine is easily to be naturally decomposed. The decomposition ways of the free chlorine includes:

1. The free chlorine is decomposed by reacting with the organic compounds contained in seawater.
2. The free chlorine is decomposed by the photo-decomposing reaction with the sunlight.
3. The free chlorine is decomposed by reacting with the metal contained in seawater.
4. The free chlorine is decomposed by reacting with the ammonia or other ammonium-deriving compounds contained in seawater. Therefore, the present invention would not result in the problem of environmental pollution encountered in the prior arts.

Preparation of Conductive Mixture

The conductive additive is mixed with the binder for preparing the conductive mixture. The content of the conductive additive contained in the conductive mixture is ranged from 15 to 25%. Preferably, the conductive additive is the graphite powder or other conductive powder with its particle size ranging from 3 to 5 microns in diameter. Preferably, the binder is selected from a group consisting of ethyl-silicate resin, silicate resin, acrylic resin and polyurethane resin.

Anti-biofouling System

Figure 2:
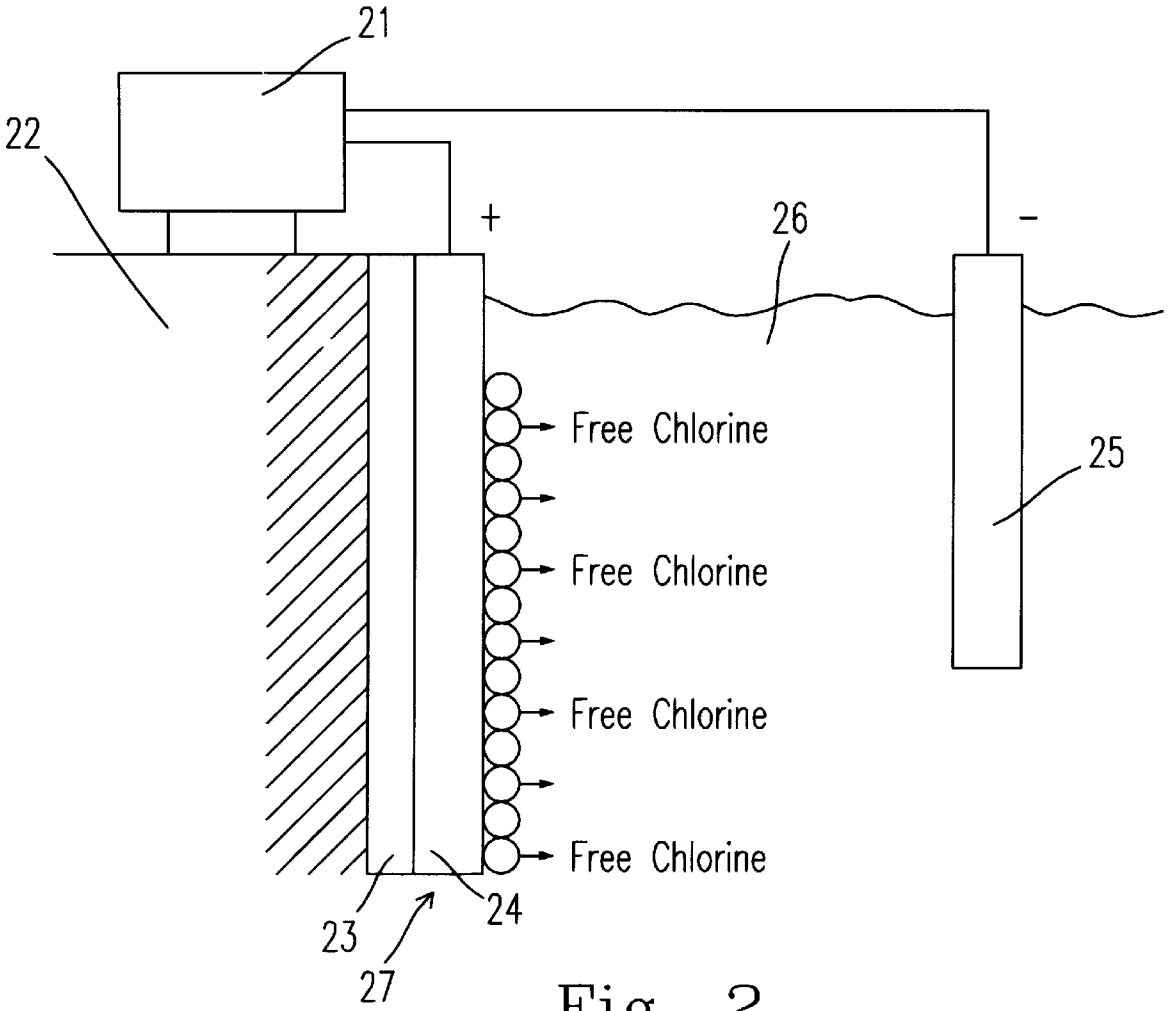
FIG. 2 is a schematic diagram showing a structure of an anti-biofouling system according to the present invention.

Please refer to FIG. 2 which is a schematic diagram showing a structure of an anti-biofouling system according to the present invention. For the underwater structure 22 being made of metal, the anti-biofouling system includes a power supply 21 for providing a current, an anti-biofouling coating layer 27 formed on the surface of the underwater structure 22, and a cathode 25. The anti-biofouling coating layer 27 includes an insulating layer 23 and a conductive layer 24 for serving as an anode. The cathode can be a remote underwater metal structure 25 (as shown in FIG. 2) or a plurality of areas (not shown) uncovered by the insulating layer 23 and the conductive layer 22. The insulating layer 23 is used for preventing the underwater structure 22 being made of metal from contacting with the conductive layer 24, or the underwater structure 22 would be corroded simultaneously when the electrolytic reaction is performed. Once the electrolytic reaction is performed, the hypochlorite ion ($ClO^-$) would be produced from the conductive layer 24 for prohibiting the fouling organisms from attaching on the surface of the underwater structure 22.

Figure 3:
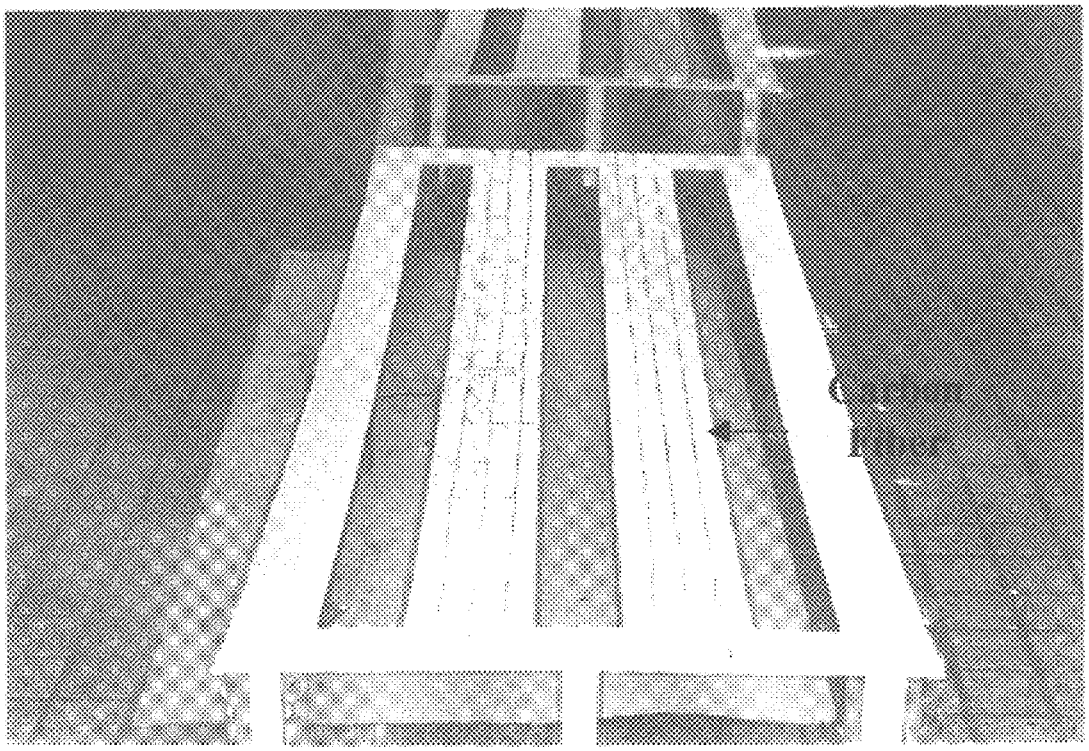
FIG. 3 is a schematic diagram showing the carbon fiber covered on the surface of the third insulating coating layer before the third insulating coating layer gets hardened.
Figure 4:
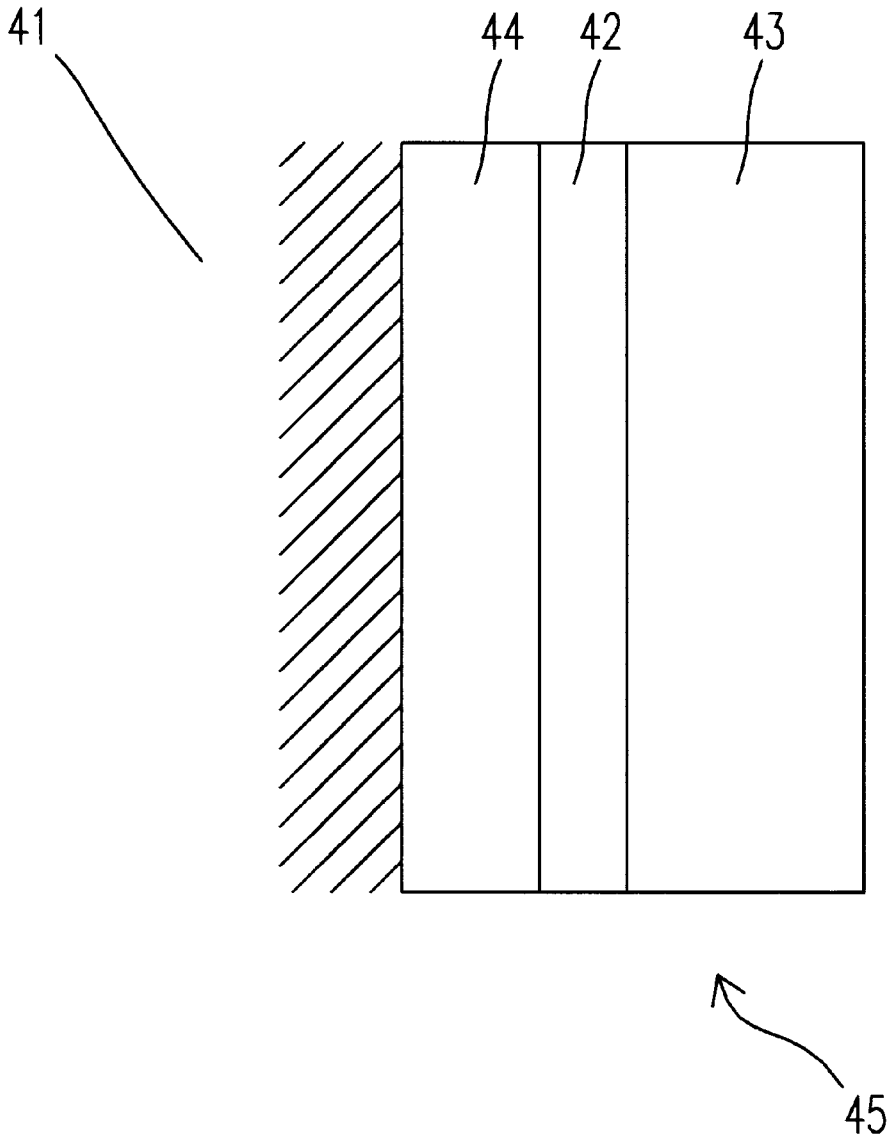
FIG. 4 is a schematic diagram showing a structure of an anti-biofouling coating layer according to the present invention.

Please refer to FIG. 4 which is a structure of an anti-biofouling coating layer 45 according to the present invention. The method for forming the anti-biofouling coating layer 45 includes the steps of a) forming a first insulating coating layer on the surface of the underwater structure 41, b) forming a second coating layer on the surface of the first insulating coating layer after the first insulating coating layer gets hardened, c) forming a third coating layer on the surface of the second insulating coating layer after the second insulating coating layer gets hardened, d) covering the carbon fiber on the surface of the third insulating coating layer before the third insulating coating layer gets hardened (as shown in FIG. 3), and e) applying the conductive mixture prepared by the method described above to the surface of the carbon fiber and the hardened third insulating coating layer for forming a conductive layer 43. Preferably, the first, the second and the third insulating coating layers are epoxy layers or made of other insulating materials. The first, the second and the third insulating coating layers compose the insulating layer 44. The pin holes would not be produced on the insulating layer 44 if which is formed by coating the insulating mixture on the surface of the underwater structure for several times. In the preferred embodiment of the present invention, the insulating layer 44 is formed by coating the insulating mixture on the surface of the underwater structure for three times, that is successively forming the first, the second and the third insulating coating layers. Preferably, the thickness of the first and the second insulating coating layer is ranged from 80 to 120 microns, the thickness of the third insulating coating layer is ranged from 120 to 150 microns, and the thickness of the conductive layer is ranged from 150 to 200 microns.

For the underwater structure being not made of metal, an insulating layer is not required to be formed on the surface of the underwater structure because the underwater structure would not be corroded.

Anti-biofouling Result

For the conductive layer formed on the surface of the underwater structure serving as an anode and a remote underwater metal structure serving as a cathode, a current density of the anode ranged from $3\times10^{-4}$ to $5\times10^{-4}$ is provided by a power supply in order to electrolyze the seawater for one hour a day. The current density and the electrolyzing time can be suitably regulated in different biofouling circumstances. The concentrations of the free chlorine and the total chlorine is measured within the distance of 10 cm away from the surface of the underwater structure.

Figure 5A:
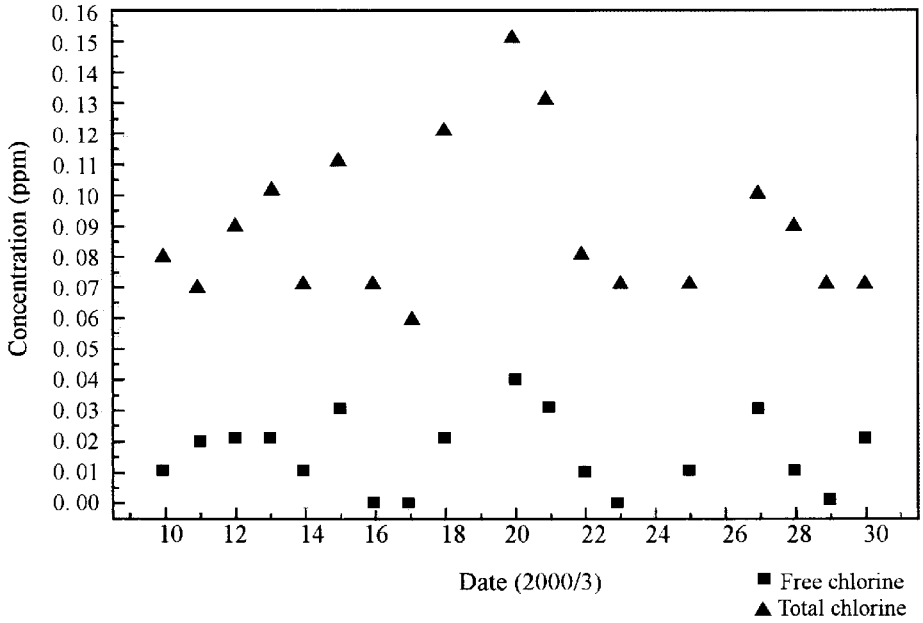
FIGS. 5(*a*)~(*c*) are schematic diagrams showing the measured concentrations of the free chlorine and the total chlorine in the natural circumstance during March to May, 2000.
Figure 5B:
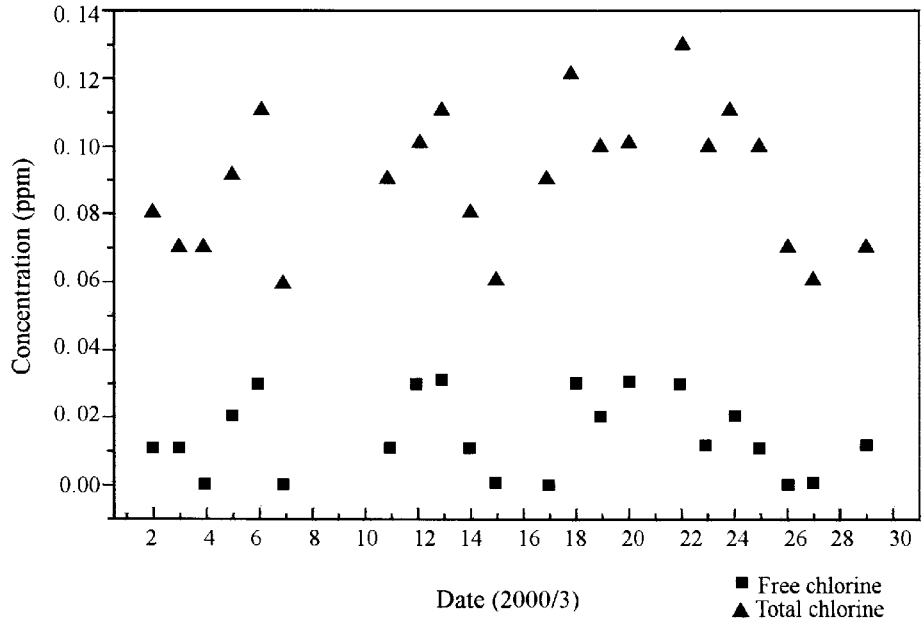
Figure 5C:
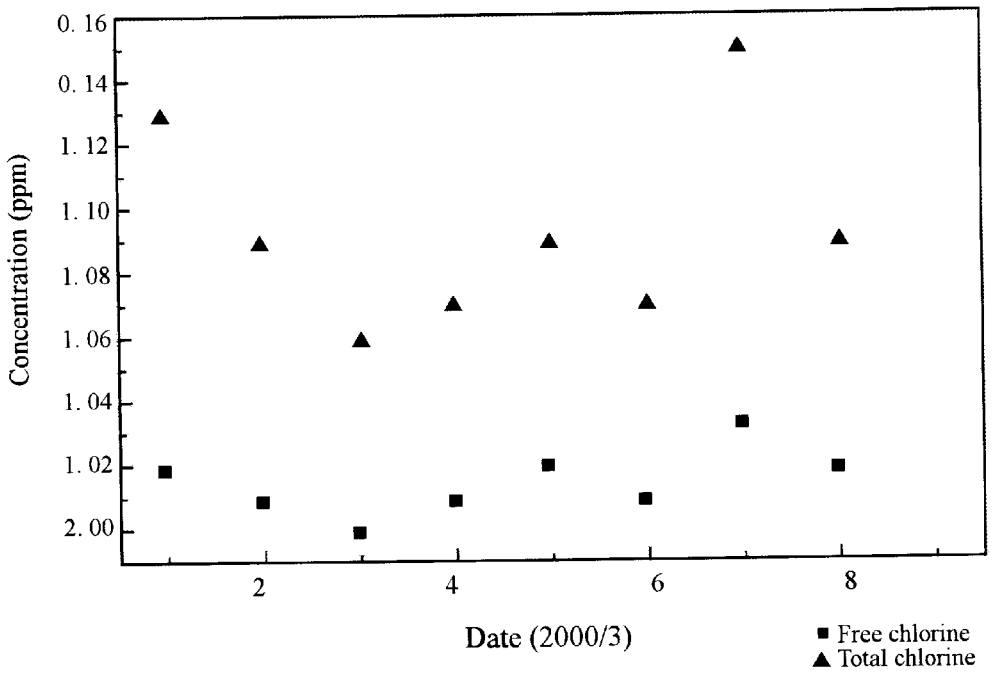
Figure 6A:
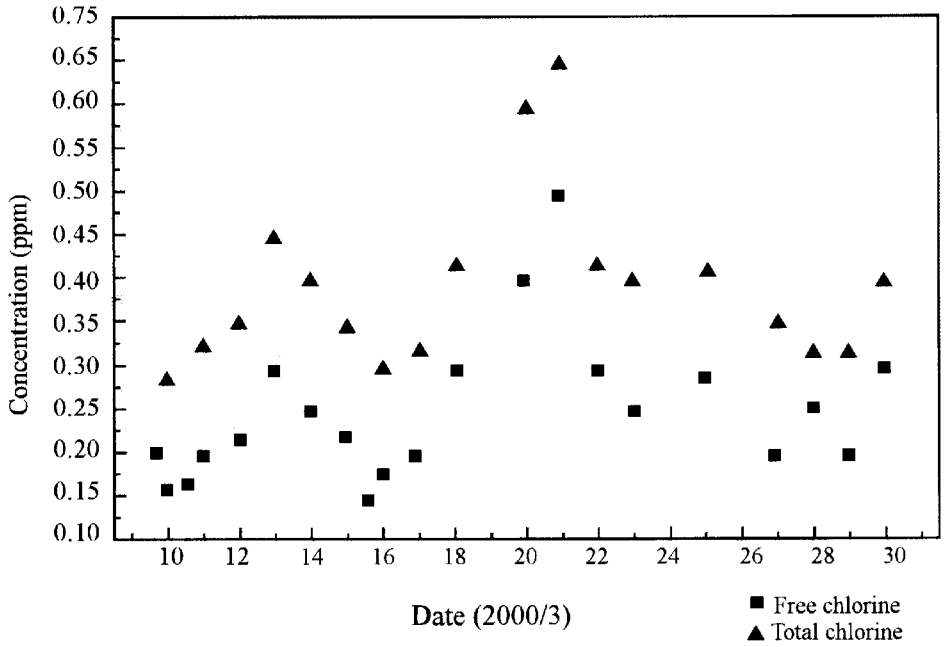
FIGS. 6(*a*)~(*c*) are schematic diagrams showing the measured concentrations of the free chlorine and the total chlorine in the circumstance applying the anti-biofouling system during March to May, 2000.
Figure 6B:
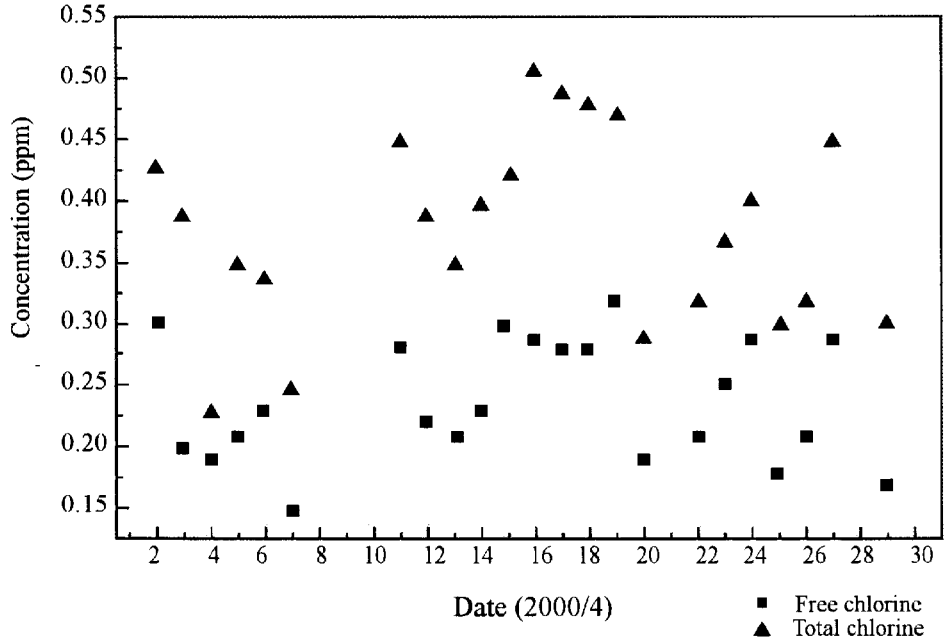
Figure 6C:
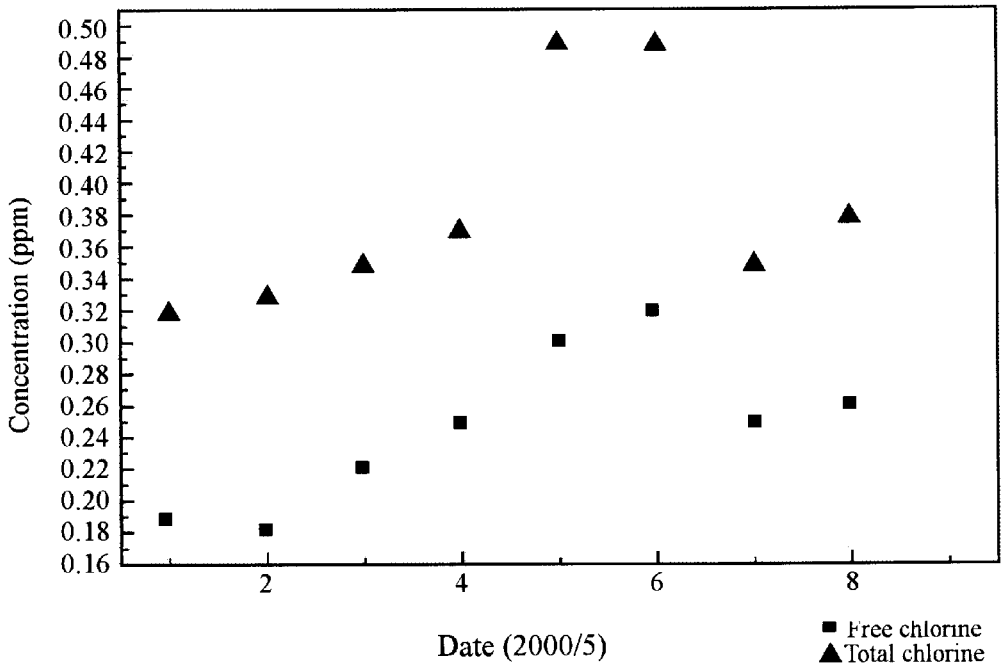

Please refer to FIGS. 5(*a*)~(*c*) and FIGS. 6(*a*)~(*c*) which are schematic diagrams respectively showing the measured concentrations of the free chlorine and the total chlorine in the natural circumstance and in the circumstance applying the anti-biofouling system during March to May, 2000. It is clear that, in the circumstance applying the anti-biofouling system, the measured concentration of the free chlorine is higher than 0.05 ppm within the distance of 10 cm away from the surface of the underwater structure. Therefore, the fouling organisms can be effectively prohibited from attaching on the surface of the underwater structure.

Figure 7:
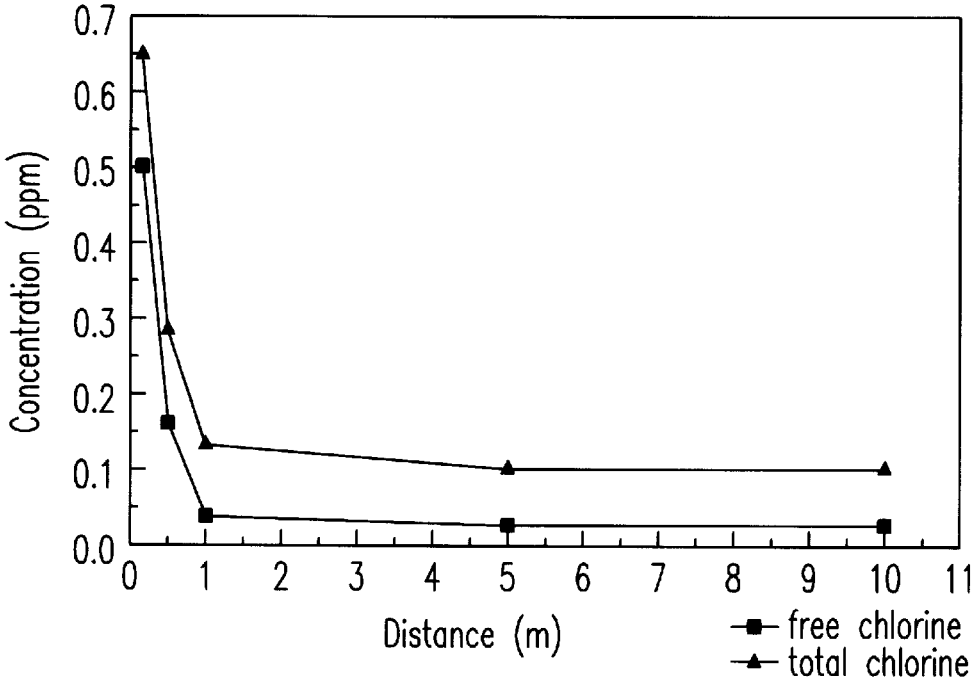
FIG. 7 is a schematic diagram showing the relationship between the distance from the surface of the underwater structure and the concentrations of the free chlorine and the total chlorine according to the present invention.

Please refer to FIG. 7 which is a schematic diagram showing the relationship between the distance from the surface of the underwater structure and the concentrations of the free chlorine and the total chlorine according to the present invention. The concentrations of the free chlorine and the total chlorine away from the surface of the underwater structure for one meter in the circumstance applying the anti-biofouling system are almost the same with that in the natural circumstance. Therefore, the present invention would not result in the problem of environmental pollution.

According to the present invention, the fouling organisms can be effectively prohibited from attaching on the surface of the underwater structure, and the problem of environmental pollution encountered in the prior arts would not arise.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. An anti-biofouling system adapted to be used for an underwater structure immersed in seawater, comprising:

a conductive layer, comprising carbon fiber, graphite powder and binder, formed on a surface of said underwater structure for serving as an anode;

a cathode; and a power supply for providing a current, thereby performing an electrolytic reaction for said anti-biofouling system such that a fouling organism is prohibited from attaching on said surface of said underwater structure.

2. The system according to claim 1 wherein said underwater structure is a metal structure.

3. The system according to claim 2 wherein an insulating layer is further formed between said surface of said underwater structure and said conductive layer.

4. The system according to claim 3 wherein said insulating layer is an epoxy layer.

5. The system according to claim 2 wherein said cathode is a plurality of areas uncovered by said insulating layer and said conductive layer on said surface of said underwater structure.

6. The system according to claim 1 wherein said underwater structure is a non-metal structure.

7. The system according to claim 1 wherein said cathode is a remote underwater metal structure.

8. The system according to claim 1 wherein a particle size of said graphite powder is ranged from 3 to 5 microns in diameter.

9. The system according to claim 8 wherein a content of said graphite powder contained in said conductive layer is ranged from 15 to 25%.

10. The system according to claim 1 wherein said binder is selected from a group consisting of ethyl-silicate resin, silicate resin, acrylic resin and polyurethane resin.

11. A method for prohibiting a fouling organism from attaching on a surface of an underwater structure immersed in seawater, comprising steps of:

(a) providing an anti-biofouling system; and (b) performing an electrolytic reaction by said anti-biofouling system, wherein said anti-biofouling system comprises:

a conductive layer, comprising carbon fiber, graphite powder and binder, formed on said surface of said underwater structure for serving as an anode;

a cathode; and a power supply for providing a current.

12. The method according to claim 11 wherein said current is provided by said power supply for one hour everyday.

13. The method according to claim 12 wherein a current density of said anode is ranged from $3\times10^{-4}$ to $5\times10^{-4}$ $A/cm^2$.

14. The method according to claim 11 wherein said underwater structure is a metal structure.

15. The method according to claim 14 wherein an insulating layer is further formed between said surface of said underwater structure and said conductive layer.

16. The method according to claim 15 wherein said insulating layer is an epoxy layer.

17. The method according to claim 14 wherein said cathode is composed of a plurality of areas on said surface of said underwater structure where said insulating layer and said conductive layer are not formed thereon.

18. The method according to claim 11 wherein said underwater structure is a non-metal structure.

19. The method according to claim 11 wherein said cathode is a remote underwater metal structure.

20. The method according to claim 11 wherein said binder is selected from a group consisting of ethyl-silicate resin, silicate resin, acrylic resin and polyurethane resin.

* * * * *